US005927552A

United States Patent [19]

Toshima

[11] Patent Number: 5,927,552

[45] Date of Patent: Jul. 27, 1999

[54] DEVICE FOR DISCHARGING CONTENTS FROM BAG

[75] Inventor: Isao Toshima, Kanagawa-ken, Japan

[73] Assignees: Kabushiki Kaisha Hoseki Planning, Tokyo; Sanwa Automatic Machinery Co., Ltd., Osaka, both of Japan

[21] Appl. No.: 08/982,605

[22] Filed: Dec. 2, 1997

[30] Foreign Application Priority Data

Jun. 17, 1996 [JP] Japan ..... 8-175425

[51] Int. Cl.[6] ..... B65D 35/28

[52] U.S. Cl. ..... 222/95; 222/105; 222/382

[58] Field of Search ..... 222/95, 105, 180, 222/382

[56] References Cited

U.S. PATENT DOCUMENTS

| | | | |
|---|---|---|---|
| 1,943,603 | 1/1934 | Hartman | 222/180 X |
| 2,539,615 | 1/1951 | Fox et al. | 222/382 X |
| 3,087,518 | 4/1963 | Scholle | 222/105 X |
| 3,171,571 | 3/1965 | Daniels | 222/105 X |
| 4,883,201 | 11/1989 | Poulton | 222/105 |
| 5,339,989 | 8/1994 | Coleman | 222/105 |
| 5,382,117 | 1/1995 | Rings et al. | 222/105 X |
| 5,435,464 | 7/1995 | Alexander et al. | 222/105 |
| 5,628,430 | 5/1997 | Barbe | 222/382 X |
| 5,682,929 | 11/1997 | Maginot et al. | 2322/105 X |
| 5,743,432 | 4/1998 | Barbe | 222/382 X |

FOREIGN PATENT DOCUMENTS

| | | |
|---|---|---|
| 1579379 | 8/1969 | France . |
| 3021089A1 | 12/1981 | Germany . |
| 8528561 | 12/1985 | Germany . |
| 4220651A1 | 12/1993 | Germany . |
| 7-76354 | 3/1995 | Japan . |
| 8204242 | 12/1982 | WIPO . |

*Primary Examiner*—Kenneth Bomberg
*Attorney, Agent, or Firm*—Jordan and Hamburg LLP

[57] ABSTRACT

Disclosed is a device for discharging the contents of a plastic bag comprising a pump having a suction nozzle for sucking the contents, a rotor mounted on a tip of the suction nozzle, a motor for driving the rotor mounted on the upper end of the suction nozzle and a discharge outlet provided at an upper portion of the suction nozzle, the pump being supported with a stand movable up and down, and a suspending member for supporting the plastic bag filled with fluid in a standing state, the suspending member being installed on the stand. The plastic bag is preferably a gusset bag having at least one vertical fused area, which is formed on a site not overlapping with a gusset fold, on at least one face of the plastic bag, wherein both edge portions of a film constituting the bag are fused with a sealing tape from the outside, and the bag can be opened by pulling one end of the sealing tape.

10 Claims, 3 Drawing Sheets

DEVICE FOR DISCHARGING CONTENTS FROM BAG

FIELD OF THE INVENTION

The present invention relates to a device for discharging almost all fluid from a sealed bag for fluid having a volume as large as 5 to 20 liters or more, particularly a bag in which high-viscosity fluid is sealed, reducing adhesion of the fluid to a wall of the bag as greatly as possible.

BACKGROUND OF THE INVENTION

Some packages have been used in transporting products. For transporting fluid consumed in large amounts for business use, drum cans have previously been used. However, the drum cans have the problems that high cost is required for treatment after use, and that empty cans themselves are voluminous to cause them to occupy wide space during storage.

Recently, the so-called bag-in-box system has been widely used as packaging not voluminous after use of the contents and recyclable. In this system, a flexible plastic bag is filled with the fluid contents, and the resulting filled bag is housed in a cardboard box for avoiding shock.

In the bag-in-box system, the cardboard box can be folded after use and stored in a compact form, and is also recyclable. The plastic bag can be easily discarded, for example, burned, because of its non-voluminousness. However, there has been the problem that the contents charged into the plastic bag is difficult to be taken out of the bag because of lack of the self-sustaining of the bag itself, even if the bag is housed in the cardboard box.

As a technique for efficiently taking out fluid charged into a plastic bag, a bag equipped with a special discharge outlet and a pump having a suction mouth brought into engagement with this special discharge outlet have been proposed. However, this technique has the disadvantage that the bag equipped with the special discharge outlet is expensive.

Further, when the contents are high-viscosity fluid such as jam, honey, mayonnaise, ketchup, pur F, adhesives, paints and ink, even this method has a limitation on suction force of the pump, and therefore it is impossible to smoothly suck the contents.

Furthermore, even according to this method, it is difficult to take out the contents remaining in a bottom of the bag, and the contents adhered to the inside of the bag are uselessly discarded.

SUMMARY OF THE INVENTION

According to the present invention, there is provided a device for discharging the contents of a plastic bag comprising a pump having a suction nozzle for sucking the contents, a rotor mounted on a tip of said suction nozzle, a motor for driving said rotor mounted on the upper end of said suction nozzle and a discharge outlet provided at an upper portion of said suction nozzle, said pump being supported with a stand movable up and down, and a suspending member for supporting the plastic bag filled with fluid in a standing state, said suspending member being installed on said stand. Further, said plastic bag is preferably a gusset bag having at least one vertical fused area, which is formed on a site not overlapping with a gusset fold, on at least one face of the plastic bag. Both edge portions of a film constituting the bag are fused with a sealing tape from the outside, and the bag can be opened by pulling one end of said sealing tape.

DETAILED DESCRIPTION OF THE INVENTION

Figure 2:
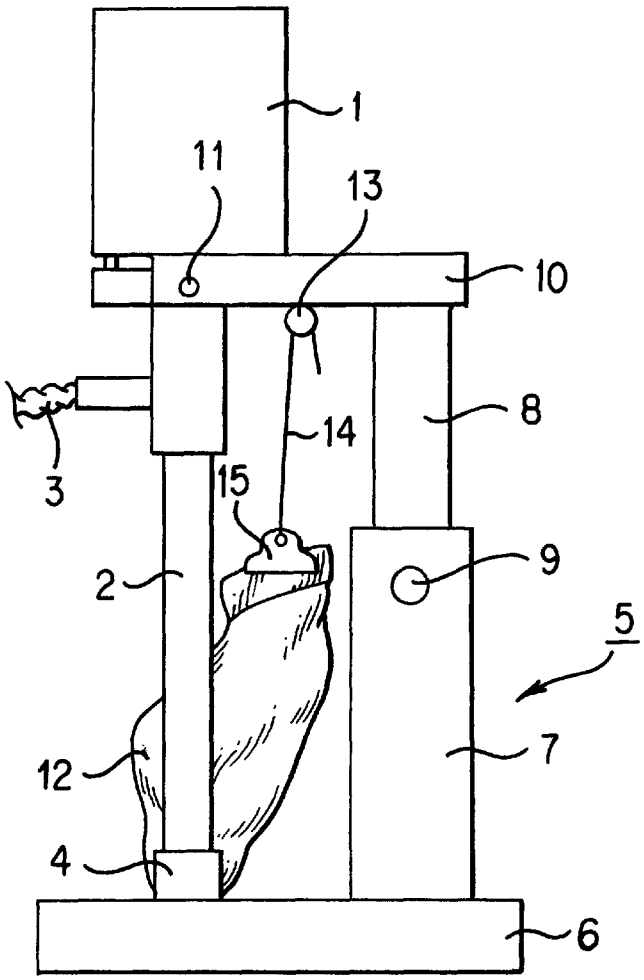
FIG. 2 is a side view showing the device in which the contents of the bag are almost discharged.
Figure 1:
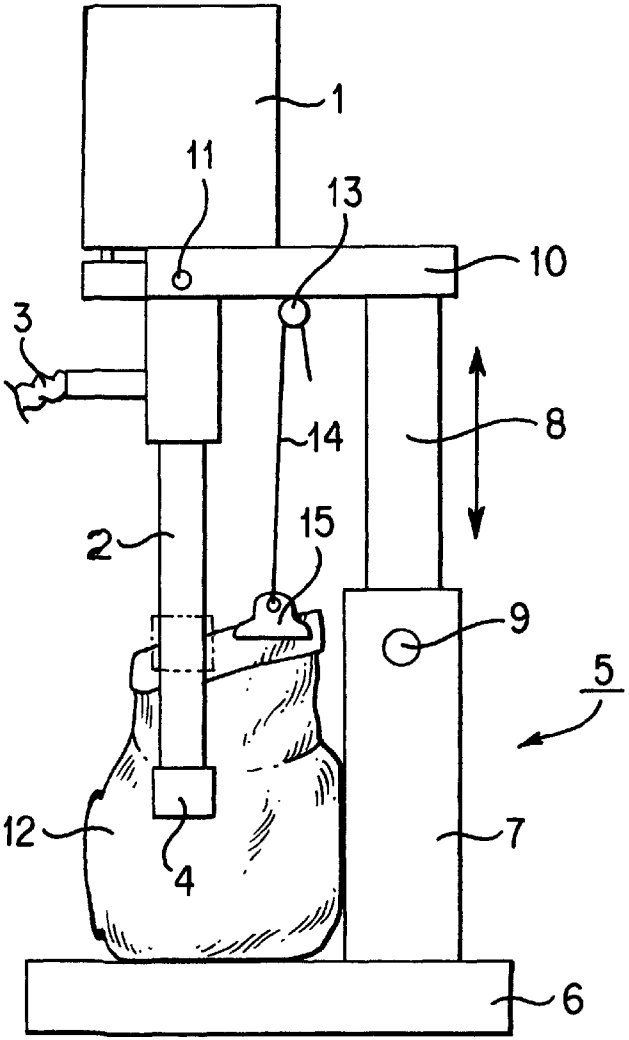
FIG. 1 is a side view showing a device of the present invention in which a bag is placed on a pedestal.

In a suction pump used in the present invention, a suction nozzle 2 extends downward from a motor 1, and a discharge outlet 3 is formed between the motor 1 and the suction nozzle 2, as shown in FIGS. 1 and 2. The numeral 4 denotes a rotor mounted on a tip of the suction nozzle 2.

The suction pump is attached to a stand 5 movable up and down. The numeral 6 denotes a pedestal supporting a stay base 7. A movable stay portion 8 extends from an upper end of the stay base 7. That is, a lower portion of the movable stay portion 8 is housed in the stay base 7. The numeral 9 denotes an adjusting handle for adjusting the height of the movable stay portion 8 and fixing it suitably.

A horizontal rod 10 to which a base of the motor 1 is fixed extends horizontally from an upper end of the movable stay portion 8. Accordingly, the stay base 7, the movable stay portion 8 and the horizontal rod 10 have strong structure resisting the weight of the motor 1. The numeral 11 denotes a fastener for connecting the horizontal rod 10 to a lower portion of the motor 1.

The whole pump moves up and down by an up-and-down movement of the movable stay portion 8.

A suspending member 13 for supporting a bag 12 in a standing state is installed on the stand 5. When the height of the stand 5 is insufficient, a suspending rod extending upward from the horizontal rod 10, the movable stay portion 8, the pedestal 6 or the stay base 7 can be used.

As the suspending member 13, a mere hook or ring can be used, as long as it can fix one end of a pulling member such as a rope or a chain. However, a suspending member which can adjust the length of the pulling member is more preferably used. It is further preferred that a fastener for supporting an upper portion of the bag 12 is attached to one end of the pulling member. However, the upper portion of the bag 12 may only be bound with one end of a string hung on the suspending member, or may be bound with a string through holes formed thereon.

In FIG. 1, a rope 14 is hung on the suspending member 13, as the pulling member, and a clip 15 for supporting the upper portion of the bag 12 is attached to one end of the rope 14. The suspending member 13 is in the form of a bobbin winder, thereby making it possible to adjust the length of the rope 14 or fix it. However, a length adjusting implement may be attached to an intermediate portion of the rope 14. As the suspending member, one comprising a center axis rotatably fixed to a disk and a stopper for fixing the pulling member at its required length may be used. Alternatively, many hooks which can be hooked with each other may be intermittently attached to an intermediate portion of the rope 14, and any two hooks are hooked with each other to adjust the length of the rope 14.

There in no particular limitation on the large-volume plastic bag, as long as it is made of a plastic film. Examples of the bags include three sided sealing type, four sided sealing type, gusset type and stand type bags. However, in order to prevent rubbing against a cardboard box, the gusset type bag having a nearly rectangular parallelepiped shape in the state in which the bag is filled with the contents is preferred. Further, when a film is welded by fusion to make the bag, so called "inner to inner" welding in which inner surfaces of both edges of the film are welded by fusion to each other, so called "outer to outer" welding in which an outer surface of one edge of the film is welded to an inner surface of the other edge thereof, and tape welding in which both edges of the film are allowed to come close to each other, and welded with a fusible tape over both edges is used as vertical fusing methods. Two or more vertical fused areas are allowed.

In the present invention, the suction nozzle of the pump is inserted into the bag from the upper portion thereof, so that the bag is preferably opened as wide as necessary at the upper portion.

Figure 3:
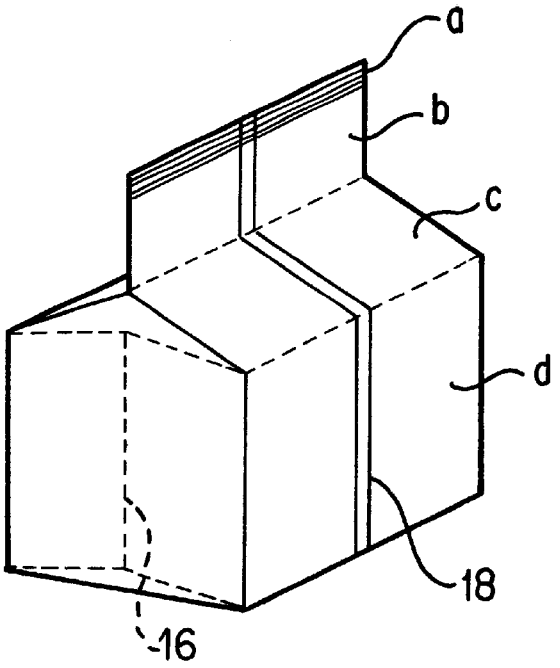
FIG. 3 is a perspective view showing a gusset type bag fused with a sealing tape.

The most preferred bag is a gusset bag vertically welded with a tape as shown in FIG. 3. In the production of the bag, a film having heat fusible layers on both sides is used. Both edges of the film are allowed to come close to each other, and a sealing tape is fused on both of the edges with a contact surface thereof faced inward. According to this fusing method, the bag is difficult to be ruptured even if the adhesive strength is low. That is, the inner pressure of the filled bag is simply applied to the whole bag from the inside thereof. Accordingly, this pressure only presses the film and the sealing tape in the same direction, and does not act as the stress for peeling both edges of the film adhered to each other. Only the force acting in a direction to peel the film from the sealing tape, namely, only the force pulling the film and the sealing tape in directions opposite to each other, acts as the stress which ruptures the bag.

Further, the filled bag welded with the tape is opened by stripping the sealing tape from the upper portion thereof. Accordingly, the contents can be discharged while keeping the shape of the bag by partly stripping the tape by a length sufficient to insert the suction nozzle 2 into the bag at the upper portion thereof. With an decrease in the contents, the bag gets out of shape from the upper portion thereof, resulting in easy handling of the nozzle 2.

When the contents are frequently reused like paints and ink and intended to be hermetically maintained, it is preferred that the sealing tape can be returned to the opened site to stick it thereon, thereby sealing the bag again. In this case, an adhesive which can be stripped and adhered again is used on a fusing surface of the tape. Such sealing tapes, commercial products such as T. A. F. 540C (trade name, easily cut film manufactured by Tosero Co., Ltd.) can be used. Edges of the film for the bag to be vertically welded by fusion may be turned outward, and outer surfaces of the edges turned outward may be coated with an adhesive which can be adhered again. In this case, the turned portions of the bag can be adhered to each other, allowing them to face to each other.

In the present invention, the suction pump having the suction nozzle and the rotor directly mounted on the tip thereof is supported integrally with the stand which moves the pump up and down, and the suspending member for suspending the large-volume plastic bag filled with the contents by pinching the upper end thereof is installed on this stand. As a result, almost all of the weight of the plastic bag filled with the contents is supported by a pedestal, similarly to the case that it is placed on the pedestal, and the upper portion thereof is always pulled up to maintain the bag in a standing state.

Accordingly, the plastic bag filled with the contents is first placed on a determined place, and the upper portion of the bag is opened. The tip of the suction nozzle is inserted into the contents through the opening of the bag by an up-and-down movement of the pump having the suction nozzle, and the contents are discharged while keeping the bag in the standing state by pulling up the upper end of the bag with the suspending member.

When the contents are contained in large amounts, they can be sufficiently sucked even by shallow insertion of the suction nozzle. However, when the contents are decreased, the position of the pump, namely the position of the suction nozzle, is lowered. The contents adhered to the inside of the bag are gradually collected downward by the weight of the contents themselves and slippage caused by the smoothness of a raw material of the bag, and little left on the inside of the bag.

Here, the upper end of the bag is further pulled up with the suspending member so that one corner of the bottom of the bag reaches the lowermost end, and a tip of the suction nozzle is brought into contact with the lowermost, thereby permitting substantially all of the contents to be easily discharged by suction as shown in FIG. 2.

Further, the pump in which the rotor is mounted on the tip of the suction nozzle has high suction force, and can suck even fluid having a viscosity as high as 30,000 cps to discharge it.

The fluid used in the present invention includes low-viscosity liquid of 50 cps or less such as water to semi solid fluid such as mayonnaise, and also includes liquid having a viscosity of 30,000 cps or more, as long as it can be sucked with the pump used in the present invention.

The present invention is particularly effective in the large-volume plastic bags. The large-volume plastic bag means a plastic bag having a volume of at least about 5 liters to 20 liters or more. In general, such large-volume bags are housed in cardboard boxes for preventing damages in the course of distribution.

The suction pump used in the present invention is a pump in which the rotor is mounted on the tip of the suction nozzle. The pump of such a type is high in suction efficiency and suitable for suction and discharge of high-viscosity fluid, because the rotor for suction exists at a site where it comes into direct contact with fluid to be sucked. As such a pump, for example, a VIDER (mdp) pump (trade name, manufactured by Miura Co., Ltd.) is preferably used.

EXAMPLE 1

A pump was attached to the stand 5 movable up and down shown in FIGS. 1 and 2. The motor 1 was placed on an upper portion of the horizontal rod 10, and fixed with the fastener 11. This pump comprises the suction nozzle 2 extending downward from the motor 1, the discharge outlet 3 formed between the motor 1 and the suction nozzle 2, and the rotor mounted on the tip of the suction nozzle 2.

A leg portion of the stand 5 comprises the stay base 7 and the movable stay portion 8, and the lower portion of the movable stay portion 8 is housed in the stay base 7 by operation of the adjusting handle 9. The rotor 4 is therefore moved up and down with an up-and-down change in the length of an exposed portion of the movable stay portion 8. In FIG. 1, when the movable stay portion 8 is further pulled out, the position of the rotor 4 is elevated to the position shown by the two-dot chain line. When a new filled bag is set, the rotor 4 is preferably placed in the position shown by the two-dot chain line or in a higher position than that.

The numeral 13 is the suspending member fitted to a lower portion of the horizontal rod 10. The rope 14 having the clip 15 fixed to one end thereof was hung thereon, and a device was provided which can pull out the rope 14 to any length and fix it. In the s t ate of FIG. 1, the bag 12 placed on the pedestal 6 is kept in the standing state with the contents filled, and in the state of FIG. 2, the residual contents are collected in one portion of the bottom of the bag, the rotor 4 is inserted into this portion, and substantially all of the contents left in the bag are sucked to discharge them from the discharge outlet 3.

A bag filled with 10 liters of ketchup was used in this example. As a film for the bag, a three-layer laminated film of LLDPE#20-30//ON#15//LLDPE#80 was used, wherein LLDPE is an abbreviation of linear low-density polyethylene, ON is an abbreviation of oriented nylon, and the numerals shown after # as the suffixes indicate thicknesses of the films in $\mu$m.

Figure 5:
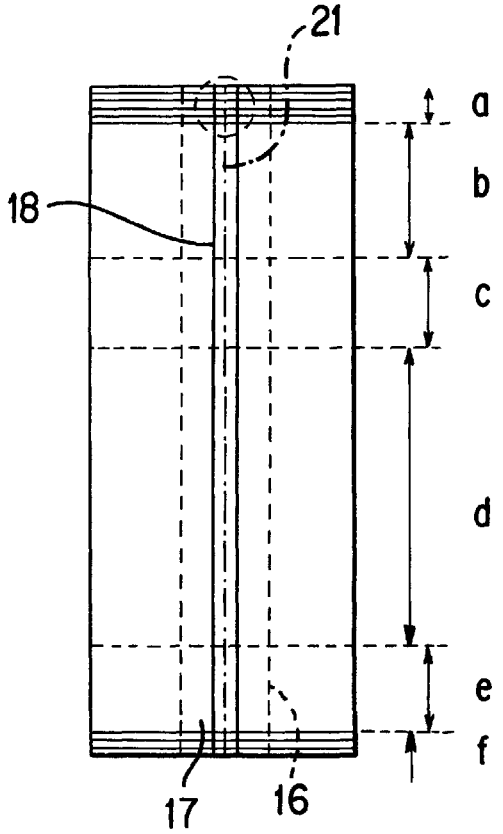
FIG. 5 is a plan view showing a gusset bag fused with a sealing tape in which no contents are charged.

A 800-mm wide film was used, and 80-mm gusset folds were formed on both edges as shown in FIG. 5. Designated by broken lines 16 are gusset fold lines. The width of the bag was 240 mm, and therefore, a 80-mm non-gusset fold area 17 having no gusset fold was left in a center portion. A vertical fused area was formed in a center portion of one non-gusset fold area 17. In the present invention, both edges of the film were allowed to come close each other, and a sealing tape 18 having a special sealant layer was welded thereon by fusion.

As the special sealants, T. A. F. 610C#25 manufactured by Tosero Co. Ltd., CMPS 017C#50 manufactured by Tosero Co. Ltd. and VMX XR 22FT#30 manufactured by Mitsubishi Chemical Corporation can be used.

As the sealing tape 18, a 27-mm wide tape of KPET#12//ON#15//T. A. F. 610C#25 was used, wherein KPET is an abbreviation of a polyvinylidene chloride-coated polyester, and the numerals shown after # as the suffixes indicate thicknesses of the films in a $\mu$m.

Figure 6:
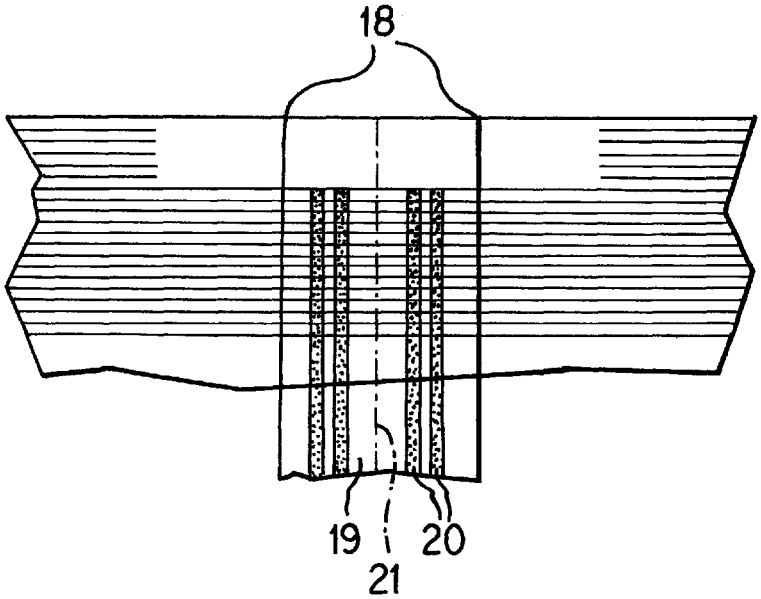
FIG. 6 is an enlarged plan view of a part encircled with a broken line in FIG. 5.

When the sealing tape 18 was welded by fusion, a 8-mm wide non-fused area 19 was left in a center portion, 2-mm wide fused areas were formed on both edges thereof, 1.5-mm wide non-fused areas were further left, and 1.5-mm wide fused areas were formed, as shown in FIG. 6. Accordingly, four fused areas 20 were formed, and 4.5-mm wide non-fused areas were left on both edges of the sealing tape 18. The numeral 21 denotes a coming closed portion of both edges of the film for the bag.

a is an upper seal portion of an upper end of the film, and its width was 30 mm. An upper end of the center portion was left non-fused as shown in FIG. 6, and the sealing tape 18 and both sides of the film for the bag were each maintained in a free state. The sealing tape 18 at this site is used as a tongue for peeling off the tape when the bag is opened.

In FIG. 5, f is a lower seal portion having a width of 20 mm. When the bag is filled with the contents, 80 mm of a bottom portion e is used for formation of a bottom of the bag. Filling the bag with the contents forms a rectangular bag having a size of 240 mm×160 mm. A site filled with the contents is indicated by d, and has a length of 260 to 270 mm. c is an upper cover portion for covering an upper portion of the contents, and has a length of about 80 mm. b is an flat portion at which both sides of the film including gusset folds are maintained in an adhered state, and has a length of 120 to 130 mm. Accordingly, the overall length of the bag itself was about 600 mm. When the bag was filled with the contents and sealed, the shape of the bag shown in FIG. 3 was formed.

Figure 4:
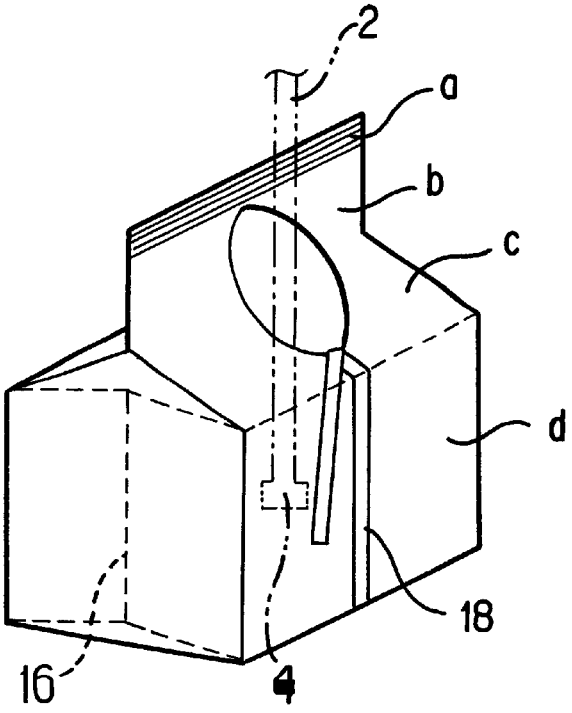
FIG. 4 is a perspective view showing the bag of FIG. 3 whose upper portion is partly opened.

When the non-fused sealing tape 18 shown in FIG. 6 which was not welded by fusion and could be freely picked was pulled, the fused areas 20 were separated to begin to open from the lower end of the upper seal portion a as shown in FIG. 4. In the state in which only the upper potion was opened, the suction nozzle 2 could be inserted into the contents. The suction in this state permitted smooth discharge of the contents from the discharge outlet 3.

When the contents were decreased, the opening of the bag was further hung up to the state shown in FIG. 2, whereby substantially all of the contents could be discharged by suction.

When the contents can not be used up all at once, the residual contents are stored with the bag opened. The use of the special sealant layer having adhesiveness even after separation allows the bag to be sealed again to store the residual contents, and can improve the keeping quality of the contents.

EXAMPLE 2

A stand similar to that used in Example 1, the same film and sealing tape as with Example 1, and a bag filled with 20 liters of mayonnaise were used. In this case, 100-mm gusset folds were formed on both edges, and the width of the bag was 300 mm. Accordingly, a 100-mm wide non-gusset fold area 17 was left in a center portion. In this case, in FIG. 5, b was 150 mm, c was 100 mm, d was 330 to 340 mm and e was 100 mm. Also in this example, mayonnaise could be discharged by suction to the last without rupture of the bag.

What is claimed is:

1. A device for discharging the contents of a plastic bag comprising a pump having a suction nozzle for sucking the contents, a rotor mounted on a tip of said suction nozzle, a motor for driving said rotor mounted on the upper end of said suction nozzle and a discharge outlet provided at an upper portion of said suction nozzle, said motor being supported with a stand movable up and down, and a suspending member for supporting the plastic bag filled with fluid in a standing state, said suspending member being installed on said stand.

2. A device as claimed in claim 1, in which said suspending member is a member which can unwind, rewind and fix a rope, and in which a clip for pinching an opening of the bag is fixed to a tip thereof.

3. A device as claimed in claim 1, in which said stand comprises a stay base extending upward from a pedestal, a movable stay portion extending from an upper end of said stay base and a horizontal rod horizontally fixed to an upper end of said movable stay portion, the suction nozzle and the suspending member are mounted on said horizontal rod, and the motor for driving the rotor is mounted on the upper end of the suction nozzle through said horizontal rod.

4. A device as claimed in claim 1, in which the plastic bag is a gusset bag having at least one vertical fused area wherein both edge portions of a film constituting the bag are fused with a sealing tape from the outside so as to be openable by pulling one end of said sealing tape.

5. A device as claimed in claim 4, in which said sealing tape has a separation strength of 100 g/15 mm to 1500 g/15 mm.

6. A device as claimed in claim 5, in which said sealing tape has a separation strength of 200 g/15 mm to 1000 g/15 mm.

7. A device as claimed in claim 5, in which said sealing tape has tackiness even after separation.

8. A device as claimed in claim 5, in which the fused width of the film and the sealing tape is 1.5 mm to 5 mm.

9. A device as claimed in claim 8, in which the fused width of the film and the sealing tape is 2 mm to 4 mm.

10. A device as claimed in claim 4, in which the vertical fused area is formed on a site not overlapping with a gusset fold, on at least one face of the plastic bag.

* * * * *